US005203689A

United States Patent [19]

Duggan et al.

[11] Patent Number: 5,203,689

[45] Date of Patent: Apr. 20, 1993

[54] PREMIX BOILER CONSTRUCTION

[75] Inventors: Robert B. Duggan; James V. Goins, both of Michigan City; Donald E. Holloway, LaPorte, all of Ind.; Ronald Moulder, Newark, Ohio

[73] Assignee: The Marley Company, Mission Woods, Kans.

[21] Appl. No.: 792,679

[22] Filed: Nov. 15, 1991

Related U.S. Application Data

[62] Division of Ser. No. 597,065, Oct. 15, 1990, Pat. No. 5,109,806.

[51] Int. Cl.[5] ..... F23D 11/40

[52] U.S. Cl. ..... 431/114; 431/326; 431/328; 431/346; 431/354; 239/432; 239/553.3; 239/567; 122/13.1; 126/361

[58] Field of Search ..... 431/326, 328, 7, 114, 431/347, 348, 350, 354; 126/92 R, 92 AC, 92 B, 361, 362, 360 R; 239/556–559, 567, 432, 553.3; 122/13.1, 135.1, 367.1, 367.2

[56] References Cited

U.S. PATENT DOCUMENTS 1,368,120 2/1921 Cole ..... 239/559
4,397,631 8/1983 Fisher ..... 431/328
4,452,225 6/1984 Plant ..... 431/347
4,960,378 10/1990 Jannemann et al. ..... 431/326

FOREIGN PATENT DOCUMENTS 1132303 3/1957 France ..... 126/92 B

*Primary Examiner*—James C. Yeung
*Attorney, Agent, or Firm*—Kokjer, Kircher, Bowman & Johnson

[57] ABSTRACT

A gas boiler having a boiler unit constructed by interconnected boiler sections each having an internal waterway bounded by one or more heat transfer surfaces. Baffles on the boiler sections define serpentine flue passages, and the baffles include bypass openings formed by notches and/or slits to suppress standing waves and associated noise. A burner includes a conical burner element having burner ports arranged in clusters to enhance the flame distribution and stability. A distributor cone nested within the burner element provides a pressure drop for noise suppression. The blower shaft is equipped with a magnetic plastic washer which effects a seal against air infiltration while allowing the blower shaft to shift from side to side.

5 Claims, 3 Drawing Sheets

PREMIX BOILER CONSTRUCTION

This is a division of application Ser. No. 597,065, filed Oct. 15, 1990, now U.S. Pat. No. 5,109,806.

BACKGROUND OF THE INVENTION

This invention relates generally to boilers and more particularly to improvements in boilers of the type in which gas and air are premixed in the desired proportions and then supplied to the burner for combustion.

Gas boilers typically have cylindrical burners of the general construction shown in U.S. Pat. No. 3,936,003 to Hapgood et al. Due to the cylindrical shape of conventional burners, they are subject to various problems, most notably non-uniform flame distribution and overheating of the end opposite the inlet end of the burner. Because the cross-section of a cylindrical burner is constant and the fuel mixture is introduced at one end, the flame distribution varies considerably along the burner length, thus reducing the efficiency and the burner life. Although baffles have been used in burners to attempt to remedy the uneven flame distribution, baffles have not been able to achieve significant improvements. In addition, the need to provide baffles complicates the burner construction and increases its costs significantly.

In order to prevent the fuel mixture from passing largely through the end opposite the inlet end, cylindrical burners provide a closed or imperforate end. Consequently, the closed end becomes red hot during normal firing of the burner and an undesirable "hot spot" thus develops. The extreme heat to which the closed end is subjected can cause it to burn through or otherwise fail prematurely, and the boiler efficiency is also reduced.

Another problem with cylindrical burners is that the fabrication process is complicated because seam welding is required not only along the longitudinal seam but also at the closed end. A final problem is that the flame exhibits instability because the burner ports are arranged uniformly and the flame propagation rate or ignition velocity cannot be exceeded appreciably without creating flame instability.

Gas boilers are somewhat notorious for noise problems that arise principally from the phenomenon of combustion noise created by oscillations or pulsations in the combustion chamber coupled with pressure fluctuations in the burner fuel supply system. The combustion oscillation is characterized by a standing wave at a specific frequency in the combustion chamber. If the phase of the standing wave is such that the air/fuel supply is modulated in phase with it, the pulsation pressures are amplified and the noise is particularly objectionable. The presence of a standing wave in the flue passage provides the feedback mechanism for oscillations that generate noise. However, efforts that have been made in the past to inhibit or destroy the standing wave have created significant decreases in the boiler efficiency, and one problem is merely substituted for another if efficiency is sacrificed for the sake o noise reduction.

Another noise problem can be caused by the blower wheel which supplies the fuel-air mixture to the burner. The blower wheel cannot be balanced perfectly and some imbalance must be accepted and dealt with as a practical matter. If the blower is out of balance and the motor that drives it is mounted rigidly, vibrations are created and objectionable noise can be generated. Therefore, the motor is normally mounted resiliently so that the vibrations and noise are eliminated or at least suppressed to an acceptable level. However, the resilient mounting provides the motor shaft with side to side play, and the hole in the blower housing through which the motor shaft or blower hub extends must be oversized in order to accommodate the play that is permitted. This creates a source of air ingress into the blower housing around the shaft or hub, and the air which is drawn into the blower housing can dilute the gas/air mixture enough to create adverse effects on the combustion process.

SUMMARY OF THE INVENTION

The present invention is directed to a premix boiler which is improved in a number of respects over the boilers that have been available in the past. One feature of the invention is the provision of a conical burner in which the ports are arranged in distinct clusters. Because of the uniformly tapered shape of the cone from its inlet end toward its tip end, the flame distribution is inherently more uniform than in the case of a cylindrical burner. The tip of the conical burner can be provided with an opening which avoids the formation of a "hot spot" at this location without significantly impairing the flame uniformity or boiler efficiency.

Arrangement of the burner ports in a cluster pattern is advantageous because the blank zones between clusters provide recirculation areas that serve as ignition sources for the clusters. Even when the nominal gas velocity through the burner ports substantially exceeds the flame propagation rate (ignition velocity), flame stability is still exhibited because of the arrangement of the ports in distinct clusters. The conical burner requires only one seam weld on the cone wall and is thus more easily fabricated than a cylinder.

The present invention is also characterized by a construction that results in significant noise suppression. In this respect, a distributor cone is provided and is received in the burner cone in order to create a pressure drop between the blower and the burner. As a consequence of this pressure drop, the combustion system is acoustically decoupled from the blower system and pressure fluctuations in the blower system do not interact with the combustion process to generate noise. The distributor cone is provided with uniformly arranged openings which are individually much larger than the individual burner ports but which in the aggregate present an area that is less than the total burner port area so that a substantial pressure drop is provided across the distributor cone.

Another measure that suppresses noise is the provision of bypass openings in the flue baffles which are arranged to create a serpentine flue passage for the combustion gases. The bypass openings include notches in the baffles, long slits in the baffle edges, or, more preferably still, a combination of notches in some baffles and slits in others. The notches and slits allow controlled amounts of the flue gases to bypass the serpentine path that is followed by the great majority of the gases, and this inhibits standing waves in the flue passage. Because the standing wave provides a mechanism for noise propagation, suppression of the standing wave suppresses noise. Significantly, this desirable result is achieved without appreciably reducing the boiler efficiency because only small quantities of gas take the shortcut route and the efficiency of the heat transfer is only minimally affected.

The boiler of the present invention is constructed of separate boiler sections that may be connected together side to side in virtually any desired number to provide whatever boiler capacity is required simply by adding or subtracting sections. The combustion chamber is located near the top, and the flue passage winds its way back and forth downwardly from top to bottom. It is a particular feature of the invention that the boiler sections have a wide waterway profile at the top in the vicinity of the combustion chamber. This provides a greater quantity of water where the temperature is the hottest and also provides an increase in the heat transfer surface area at the hottest parts of the boiler. At the same time, the configuration of the boiler sections creates a recessed area in the flue passage to shield the heat transfer pins from extremely high temperatures that could damage them due to overheating.

The boiler of the present invention is equipped with a magnetic plastic washer which is able to seal the blower shaft opening effectively while also accommodating the side to side shifting of the shaft that is permitted by the resilient mounting arrangement for the blower motor. As a result, effective control of air leaking into the blower housing is provided while permitting the shaft play that is necessary to accommodate the resilient mounting of the blower motor.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
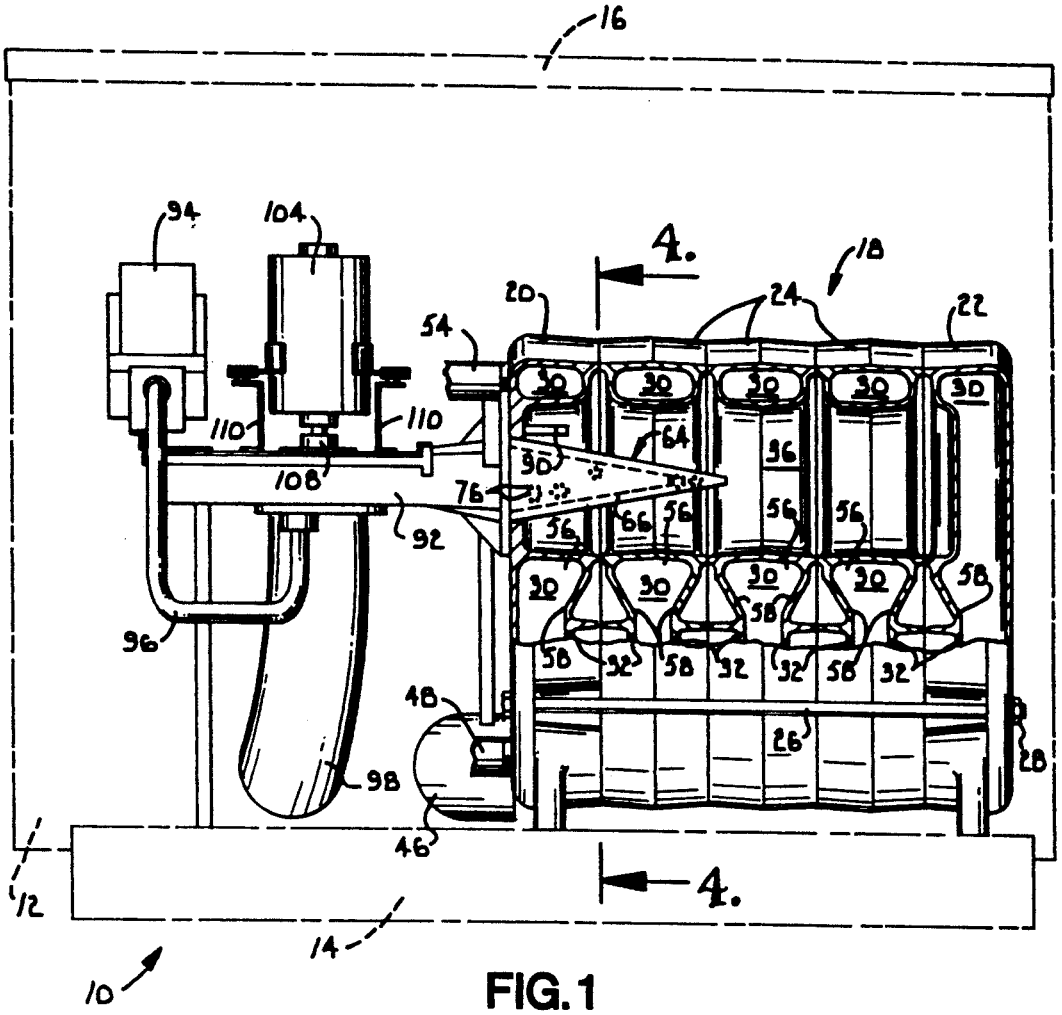
FIG. 1 is a side elevational view of a premix boiler constructed according to a preferred embodiment of the present invention, with the boiler housing shown in phantom lines and portions of the boiler sections broken away for purpose of illustration.

Referring now to the drawings in more detail and initially to FIG. 1, numeral 10 generally designates a gas-fired boiler constructed in accordance with a preferred embodiment of the present invention. The operating components of the boiler 10 are located within a sheet metal housing 12 and are supported on a base 14 which generally underlies the housing 12. A removable cover panel 16 covers the top of the housing 12 and may be removed to gain access to the interior of the housing and the operating components of the boiler.

A boiler unit which is generally identified by numeral 18 is mounted on the base 14 within the housing 12. The boiler unit 18 is constructed of a plurality of interconnected boiler sections, including a front section 20, a back section 22, and optionally, one or more intermediate sections 24. Although three of the intermediate sections 24 are illustrated in FIG. 1, it is to be understood that a greater or lesser number may be included in the boiler unit (including no intermediate sections at all). The boiler sections are connected together side to side by elongated bolts 26 and nuts 28. The boiler sections are preferably cast iron.

Figure 4:
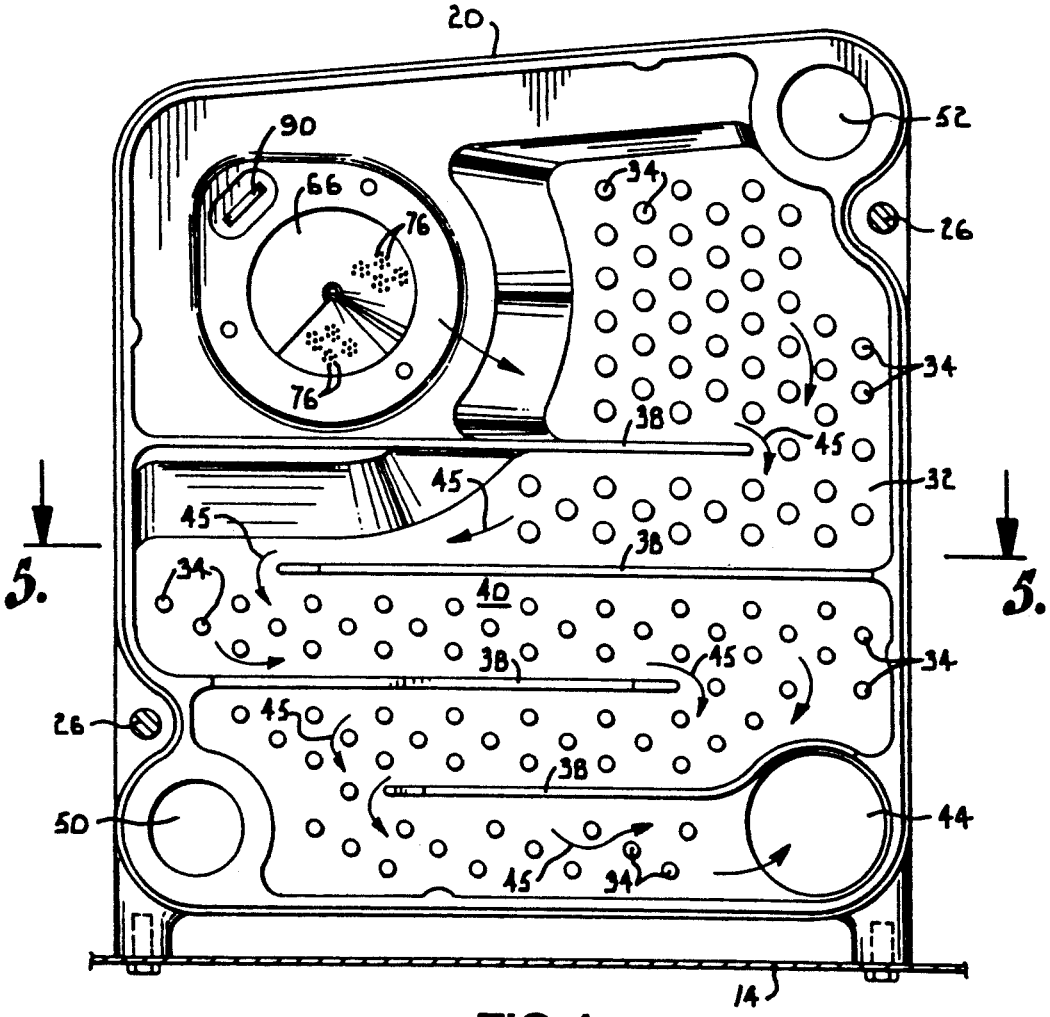
FIG. 4 is a fragmentary sectional view on an enlarged scale taken generally along line 4—4 of FIG. 1 in the direction of the arrows.
Figure 5:
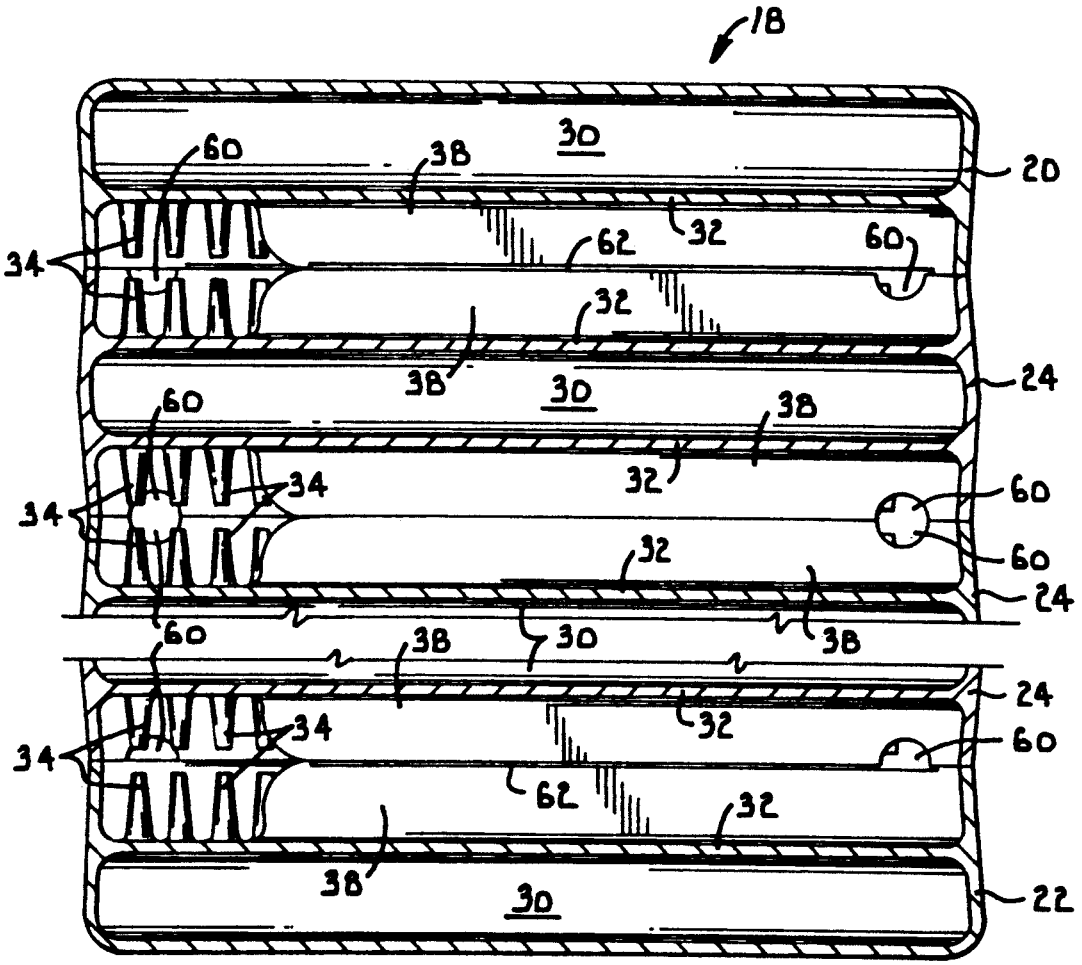
FIG. 5 is a fragmentary sectional view taken generally along line 5—5 of FIG. 4 in the direction of the arrows, with the break lines indicating continuous length.

The boiler sections which make up the boiler unit 18 are constructed similarly to one another, although the front section 20 and back section 22 differ in some respects from the intermediate sections 24. With reference additionally to FIGS. 4 and 5, each boiler section presents within it a waterway 30 bounded on at least one side by a heat transfer surface 32. On the front section 20 and the back section 22, only the inwardly facing surface is a heat transfer surface. On the intermediate boiler sections 24, heat transfer surfaces 32 are provided on both sides of the water channel 30. A plurality of heat transfer pins 34 project from each of the heat transfer surfaces 32 in order to enhance the heat transfer from the combustion gases to the heat transfer surfaces and to the water in the waterways 30. Near the top of each boiler section (except the back section 22), an opening is provided, and these openings cooperate to form a combustion chamber 36 (see FIG. 1) near the top of the boiler unit 18.

A plurality of baffles 38 project from each heat transfer surface. When the boiler unit 18 is assembled, the baffles 38 of adjacent boiler sections are arranged generally edge to edge as best shown in FIG. 5. The baffles 38 and the heat transfer surfaces 32 define between each adjacent pair of boiler sections a serpentine flue passage 40 which extends from the combustion chamber 36 to a flue collector passage 44 located near the bottom of the boiler unit 18. The flue passages 40 extend around the free edges of the baffles 38 such that the combustion gases in each flue passage follow the serpentine path indicated by the directional arrows 45 in FIG. 4. The baffles 38 thus direct the flue gases along the serpentine paths defined by the flue passages 40 and thereby increase the residence time of the hot flue gases in the boiler to maximize the heat transfer to the pins 34 and heat transfer surfaces 32. A flue pipe 46 (FIG. 1) connects with the flue collector passage 44 and directs the flue gases out of the housing 1 2 and out of the building through a suitable vent system.

As shown in FIG. 4, each flue passage 40 has successive horizontal passes defined between the baffles. The successive passes are arranged one above the other, and the gas flows in opposite directions in successive passes.

Incoming water is supplied to the waterways 30 through a return pipe 48 (see FIG. 1). The return pipe 48 connects with each waterway 30 through an inlet port 50 (see FIG. 4) located near the bottom of the boiler unit 18. Heated water is discharged from each waterway 30 through an outlet port 52 located near the top of the boiler unit. An outlet pipe 54 (see FIG. 1) connects with the ports 52 and directs the heated water to the desired location. Cooled water is returned to the boiler through the return pipe 48.

As best shown in FIG. 1, the portion of each waterway 30 that immediately underlies the combustion chamber 36 is enlarged at 56 in order to provide the waterway with a generally hourglass shape. The enlarged portions 56 of the waterways contain relatively large amounts of water, and they are located at the hottest portion of the flue passage so that the hottest combustion gases are able to heat the larger amounts of water for enhanced efficiency. The enlarged portions 56 are provided by dish-shaped portions 58 of the heat transfer surfaces 32 which are convex when viewed from the waterway side and concave when viewed from the flue passage side. Because of the dish shape of heat transfer surface portions 58, the heat transfer surface area is increased in the vicinity of the hottest combustion gases and the enlarged waterway portions 56 for further enhancement of the efficiency. At the same time, the dish portions 58 present recessed areas in the hottest portions of the flue passages 40 and thus serve as heat shields to at least partially shield the heat transfer pins 34 from the extreme temperatures adjacent to the combustion chamber 36. By reason of the dish shape of the portions 58, the pins 34 are recessed somewhat and thus protected from extreme temperatures that could damage them due to overheating.

The baffles 38 in the flue passage 40 are specially constructed to suppress noise that would otherwise result from the combustion process in the combustion chamber 36. The baffles 38 are provided with bypass openings which permit small amounts of the combustion gases to shortcut the serpentine route taken by the remainder of the combustion gases, thus suppressing standing waves in the flue passage that can provide a mechanism for acoustical problems. The bypass openings include semi-circular notches 60 which are formed through edges of some of the baffles 38 near their base ends or the ends opposite their free ends around which the flue gases pass in the flue passage 40. On the baffles 38 of the intermediate boiler sections 24, the notches 60 align with the notches of adjacent intermediate boiler sections. The baffles of the front and back boiler sections 20 and 22 are not notched but are instead provided with machined recesses which present elongated slits 62 that form bypass openings for these baffles.

The result of providing some baffles with notches 60 and other baffles with slits 62 is that small amounts of the flue gases are able to pass through the notches 60 and thus take a relatively direct route from one flue passage pass to the next. By reason of the "short cut" these gases take, disruption in the gas flow pattern results and standing waves in the flue passage are unable to establish. At the same time, the slits 62 allow small amounts of flue gases to shortcut the serpentine route followed by the gases that flow through the flue passage 40. However, the gases that flow through the slits 62 flow through them along substantially the entire length of each baffle 38, rather than taking the more direct route that is followed by the gases that pass through the notches 60. Consequently, further flow disruption and suppression of standing waves is provided by the slits 62. It has been found that a combination of the notches 60 and slits 62 is particularly effective in suppressing noise from the combustion process. However, it is to be understood that good noise suppression characteristics are exhibited by the notches 60 alone and also by the slits 62 alone, and either the notches alone or the slits alone is contemplated by the present invention.

Figure 2:
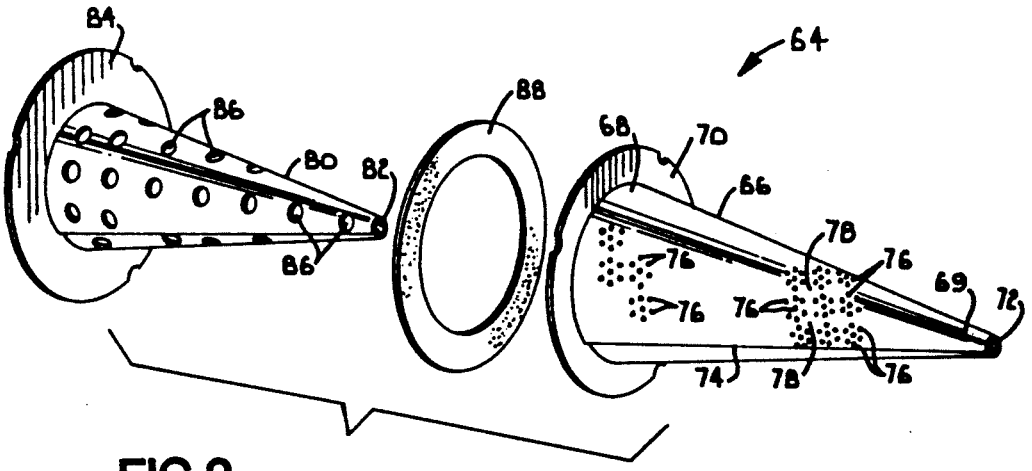
FIG. 2 is an exploded perspective view of the burner assembly showing the burner cone and the distributor cone.

The boiler 10 is a premix boiler in which gas and air are mixed in controlled quantities and then delivered to the combustion chamber for burning. The gas/air fuel mixture is supplied to the combustion chamber 36 through a burner which is generally identified by numeral 64. As best shown in FIG. 2, the burner 64 includes a burner element 66 having a conical wall which tapers uniformly from a base or inlet end 68 to a pointed tip end 69. The base end 68 is the gas inlet end of the burner 66 and is provided with a mounting flange 70. The opposite or tip end 69 of the conical burner element 66 is provided with an aperture 72. The body of the burner 66 includes only a single weld seam 74 which extends along the wall of the burner from the base end to the tip end.

The wall of the burner 66 is provided with a plurality of burner ports 76 which are arranged in a plurality of distinct clusters each including a preselected number of ports 76. In the preferred embodiment shown in FIG. 2, (each cluster of ports includes seven ports 76 arranged in a hexagonal shape) with one of the ports located at each vertex of the hexagon and the seventh port located at the geometric center of the hexagon. Each band of port clusters is parallel to the other bands. The conical burner 66 is typically cut in a fan shape from a flat sheet in which all rows or bands of port clusters are parallel. After the sheet is rolled up to form a cone, the direction of the rows or bands varies.

The arrangement of the burner ports 76 in distinct clusters and the arrangement of the clusters in parallel bands creates blank or imperforate areas 78 on the burner wall adjacent to each of the clusters between the adjacent bands. These blank areas 78 have the effect of providing recirculation zones for the gas/air mixture which is passed through the ports, and the recirculation zones in turn provide ignition sources for the adjacent clusters of ports. As a consequence, flame stability is exhibited even when the nominal velocity through each individual port far exceeds the flame propagation rate or ignition velocity (which, for natural gas with 20% excess air is approximately 0.75 feet per second). In addition, the clustering of the ports and the use of a conical burner element enhance the uniformity of the flame distribution without requiring baffles or other complications. The aperture 72 which is provided in the tip 70 of the conical burner relieves the gas/air mixture at the end opposite the inlet end and prevents significant "hot spots" from developing.

The burner assembly includes a distributor cone 80 which provides a pressure drop between the gas/air supply and the burner element 66, thus suppressing noise. The distributor cone 80 has a conical wall which is somewhat smaller than the wall of the burner and which is provided with an aperture 82 at its tip end. A flange 84 is provided on the opposite or base end of the distributor cone.

The wall of the distributor cone 80 is provided with a plurality of generally uniformly spaced round openings 86. The openings 86 are each considerably larger than the individual burner ports 76. However, the combined area presented by all of the openings 86 together is considerably less than the combined area provided by all of the burner ports 76 together. Consequently, the pressure reduction across the wall of the distributor cone 80 is greater than the pressure drop across the wall of the conical burner 66.

The burner 64 is mounted to project into the combustion chamber 36. The flanges 70 and 84 are mounted to the wall of the boiler unit 18. An annular gasket 88 may be sandwiched between the two flanges 70 and 84, or the flanges 76 and 84 may be welded together. The wall of the distributor cone 80 is spaced inwardly from the wall of the burner element 66. An ignition element 90 projects from the wall of the burner unit 18 into the combustion chamber 36 at a location near the burner 66 in order to ignite the air/fuel mixture which passes through the burner ports 76.

The air/fuel mixture is premixed and supplied to the burner from a manifold 92 (FIG. 1) which is mounted at an elevated position on one side of the boiler unit 18. The gas/air mixture is supplied to the manifold 92 from a blower assembly. The gas is supplied to the blower from a conventional gas valve 94 from which a gas line 96 extends to the blower housing. Air is supplied to the blower housing through a flexible air intake tube 98 which extends through one panel of the enclosure 12 to provide air for combustion within the combustion chamber.

Figure 3:
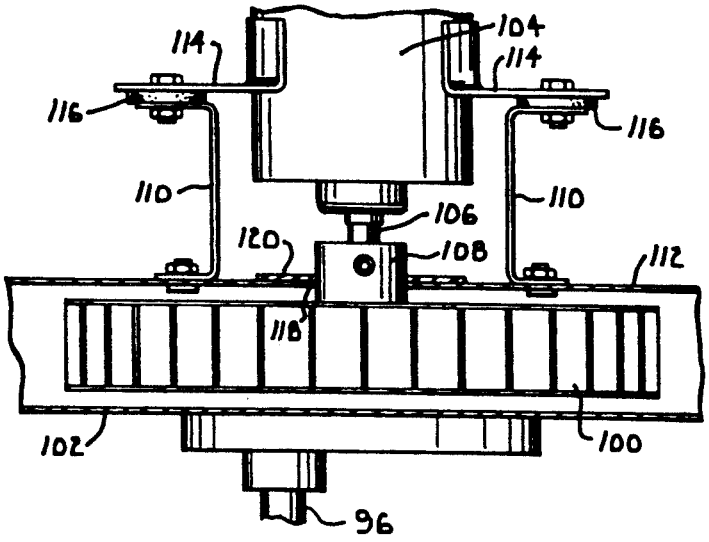
FIG. 3 is a fragmentary sectional view on an enlarged scale showing part of the blower housing and the blower and its drive motor.

The manifold 92 extends to the base or inlet end of the burner 64. The gas and air mixture is supplied to the burner 64 by a rotary blower wheel 100 which is best shown in FIG. 3 and which is mounted within a blower housing 102. The blower housing 102 connects with the manifold. The impeller wheel 100 is driven by an electric motor 104 having an output shaft 106 connected with a hub 108 of the impeller wheel 100. When the wheel is rotated by the motor 104, it draws air and gas in metered amounts into the blower housing where the air is mixed with the gas from the gas line 96 and then directed by the blower wheel to the manifold 92 and the burner 64.

In order to eliminate vibrational noise, the motor 104 is mounted resiliently. With continued reference to FIG. 3 in particular, mounting legs 110 are secured at their lower ends to a cover plate 112 which covers the top of the blower housing. Mounting lugs 114 for the motor are connected with the mounting legs 110, and a resilient pad 116 is interposed between each mounting lug 114 and the corresponding leg 110. The resiliency of the mounting pads 116 permits the motor 104 to vibrate somewhat without creating noise. Consequently, if the impeller wheel 100 is out of balance, the vibration that is thereby imparted to the motor does not create objectionable noise.

In order to permit slight vibration of the motor 104, the hub 108 extends through an opening 118 in the cover plate 112 which is somewhat larger than the hub 108. The oversize opening 118 permits the hub 108 to shift from side to side as the motor 104 vibrates. A magnetic plastic washer 120 is fitted closely around the hub 108 and seats on top of the cover plate 112 to provide an effective seal of the oversize opening 118. The washer 120 is constructed of a plastic material which is laminated to a magnetic substrate. The magnetic substrate adheres to the cover panel 112 by magnetic attraction in order to hold the washer 120 in sealing position on the cover plate 112. The plastic material which forms the outside surfaces of the washer 120 provides an effective seal so that the blower does not draw excessive air into the housing through the oversize opening 118. At the same time, the magnetic washer 120 is able to slide on the cover plate 112 from side to side as the hub 108 shifts due to vibration of the motor 104.

In operation of the boiler 10, the blower wheel 100 draws air and gas in the desired proportions into the blower housing and forces the gas/air fuel mixture through the manifold 92 to the burner 64. The gas/fuel mixture is forced through the distributor cone openings 86 and the burner ports 76 into the combustion chamber 36 where it is burned in a sealed combustion process. The combustion gases follow the tortuous or serpentine path defined through the flue passage 40 and transfer heat to the heat transfer surfaces 32 and to the water located in the waterways 30. This heats the water which passes out of the boiler through the outlet line 54.

Because of the conical construction of the burner element 66 and the cluster arrangement of the burner ports 76, the burner exhibits flame stability and a uniform flame distribution around the burner. At the same time, the bypass openings provided by the baffle notches 60 and slits 62 prevent standing waves from setting up in the combustion chamber or flue passage, and noise is thereby suppressed because standing waves can create a mechanism for noise transmission. Additionally, the blower wheel 100 and the remaining components of the fuel supply system are acoustically decoupled from the combustion chamber 36 by the pressure reduction that is created across the wall of the distributor cone 80. Further noise suppression is thereby provided.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without department from the scope thereof, it is to be understood that all matter herein set forth or shown in the accompanying drawings is to be interpreted as illustrative and not in a limiting sense.

Having thus described the invention, I claim:

1. A burner for gaseous fuel, comprising:

a burner element having a substantially conical wall tapering from a base end to a pointed tip end, said base end providing an inlet for admitting the gaseous fuel into the burner element; and a plurality of ports in said wall for passing the fuel therethrough, said ports being arranged in a plurality of separate clusters each separated from other clusters and each including a plurality of individual ports arranged in a pattern defining a hexagon having a port at each vertex and another port at the geometric center of the hexagon.

2. The burner of claim 1, including an aperture in said pointed tip end.

3. The burner of claim 1, including an imperforate area on the conical wall adjacent each cluster of ports.

4. In a boiler having a sealed combustion chamber and means for supplying a premixed air and gas mixture containing sufficient air for combustion of the gas, an improved burner construction comprising:

a burner element extending into the combustion chamber and having a substantially conical wall tapering from a base end to a tip end which presents an aperture;

a plurality of ports in said wall for passage of the mixture therethrough into the combustion chamber for combustion therein, said ports being arranged in a plurality of separate clusters each separated from other clusters and each including a plurality of individual ports;

a distributor core disposed within said burner element and having a substantially conical wall spaced inwardly from the wall of the burner element, said wall of the burner element tapering from an open base end which forms an inlet for receiving the incoming mixture to a tip end which presents an aperture; and a plurality of spaced apart openings in said wall of the distributor core for passsing the mixture to said ports of the burner element while effecting a pressure drop across the wall of the distributor core.

5. The burner construction of claim 4, wherein the ports in each cluster are arranged in a pattern defining a hexagon having a port at each vertex and another port at the geometric center of the hexagon.

* * * * *